US006062060A

United States Patent [19]

Nguyen

[11] Patent Number: 6,062,060

[45] Date of Patent: May 16, 2000

[54] TOOL KIT FOR FLARING METAL TUBES

[76] Inventor: Tien Nguyen, 29 Beckfoot Drive, Dartmouth, Canada, B2Y 4H9

[21] Appl. No.: 09/196,321

[22] Filed: Nov. 20, 1998

[51] Int. Cl.[7] ..... B21D 41/02

[52] U.S. Cl. ..... 72/317

[58] Field of Search ..... 72/317, 316, 116, 72/125, 370.06, 370.08, 370.11, 370.13, 370.1, 479

[56] References Cited

U.S. PATENT DOCUMENTS

| | | | |
|---|---|---|---|
| 1,986,025 | 1/1935 | Stecher | 72/317 |
| 2,483,982 | 10/1949 | Paquin . | |
| 2,892,480 | 6/1959 | Franck | 72/317 |
| 3,103,245 | 9/1963 | Iskyan | 72/317 |
| 3,415,100 | 12/1968 | Britts . | |
| 3,421,354 | 1/1969 | Strybel | 72/317 |
| 3,575,033 | 4/1971 | Meyer | 72/317 |
| 4,606,214 | 8/1986 | Miyazaki | 72/318 |
| 4,754,634 | 7/1988 | Murata | 72/317 |
| 4,980,961 | 1/1991 | Caudill | 72/316 |
| 5,487,294 | 1/1996 | Petersen | 72/318 |

*Primary Examiner*—Daniel C. Crane

*Attorney, Agent, or Firm*—Mario D. Theriault

[57] ABSTRACT

A tool kit including a pilotless punch for swaging tube ends with beads, flares and portions of reduced diameter. The kit is particularly useful to automechanics for reconditioning sending units on fuel tanks using common workbench tools and equipment. The tool kit includes a pair of clamping blocks cooperatively forming a chuck for enclosing a tube. Each clamping block has a flat portion along a segment thereof such that both blocks are forcibly retainable against one-another in a common shop vise for firmly clamping a tube. There is also provided a centering bushing and an annular collar for simultaneously enclosing portions of the clamping blocks and a portion of the centering bushing when the centering bushing is positioned adjacent the clamping blocks, for centering the centering bushing with the chuck. The round punch bar is mountable inside a central opening in the centering bushing. The punch bar has a first pilotless swaging die for swaging a tube end. Further, a gauge is incorporated into the centering bushing, and this gauge has a standard dimension corresponding to a required length of a tube end protruding from the chuck prior to swaging the tube end, for gauging a tube end prior to chucking it.

10 Claims, 4 Drawing Sheets

TOOL KIT FOR FLARING METAL TUBES

FIELD OF THE INVENTION

This invention pertains to tools for flaring metal tubes, and more particularly, this invention pertains to manual tools and methods for swaging and forming a bead on the end of a tube.

BACKGROUND OF THE INVENTION

Fuel injection systems in modern vehicles comprise a fuel sending unit mounted on the gas tank of the vehicle and functioning as a connection between the fuel pump and fuel gauge inside the tank, and the fuel piping system to the engine of the vehicle. The outlet tubes of a sending unit comprise swaged tube ends cooperating with mating mechanical fittings and defining with the mechanical fittings releasable connections in the fuel lines. Similar releasable connections are often found at other locations along a fuel piping system and on power steering units. These tubes, as supplied by the original manufacturer are normally made of steel and are prone to corrosion for being located under the vehicle and for being exposed to all driving conditions.

A sending unit with corroded outlet tubes is normally replaced by a new one at the expenses of the owner of the vehicle. The primary reason for not repairing sending units, which would save substantial amounts of money in repair costs, is believed to be because there are no tool available commercially to precisely manufacture the swaged tube ends using common garage equipment.

The swaging of a metal tube, and forming a bead on the end of the tube are difficult to control. It has been experienced that the tube tends to pucker, crumble or otherwise take unwanted deformation. The material of the tube may even crack or split.

Some types of bead-forming tools of the prior art have a pilot stem to enter the tube and to guide a die block onto the tube for maintaining the symmetry of the bead about the tube's axis. However, sending units of most North-American-made vehicles have tube ends formed with a bead and a reduction in tube diameter adjacent to the bead. In these cases, the use of a pilot member is useless for forming tube ends that are concentric with the axis of the tube.

It is believed that there are at least two requirements that must be taken into consideration for properly swaging a tube. The first one being that the swaging die must remain in perfect alignment with the axis of the tube, and the second being that the length of tube entering the swaging die must be precisely controlled. It is further believed that these two requirements must be found in a single tool in order to form tube ends that will not leak, that will easily engage into a mechanical fitting, and that will remain engaged in the mechanical fitting. It is believed that in general, the manual flaring tools of the prior art are lacking at least one and most often both of these structural requirements.

In a first example of the tools of the prior art, U.S. Pat. No. 2,483,982 issued on Oct. 4, 1949 to Joseph N. Paquin, discloses a manual flaring tool having a pair of elongated tube holder blocks. Each block is formed with a series of semicircular recesses which cooperate to form tube gripping bores when the blocks are brought together and clamped about a tube. A flaring head is movable along the tube holder blocks into a pair of guide channels respectively fastened to each of the tube holder blocks. A series of index marks are provided on the channel members, which marks are aligned with the axis of the corresponding tube recesses. A precise alignment of the flaring head over a tube to be flared is obtained by aligning an index mark on the flaring head with a selected index mark on one of the channel members. When this is done, the tube is readily flared by rotation of a flaring tool operator mounted through the flaring head.

In a second example, U.S. Pat. No. 3,415,100 issued on Dec. 10, 1968 to Frank J. Britts, discloses a hand tool for swaging and forming a bead near the end of a tube. The tool includes an inverted U-shaped frame portion having a pair of legs each provided with a notch for respective engagement with opposing side walls of a pair of tube clamping blocks. The blocks are provided with semicircular tube holding recesses to accommodate tubes of various diameters. The base of the U-shaped frame is provided with a threaded aperture and a threaded shaft is mounted therein. The shaft has a head and a handle adapted to rotate the shaft to move the shaft up or down. A die body is connected to the shaft and has a die opening to form the tube. A pair of slots are provided along the die body. These slots are engaged onto the legs of the U-shaped frame, and are used for guiding the die body relative to the tube during the tube forming process.

Another example of a manual swaging tool for forming a bead on a tube is disclosed in U.S. Pat. No. 3,575,033 issued on Apr. 13, 1971, to Howard F. Meyer, Jr. This tool comprises conventional flaring yoke and bar assembly similar to the previously described tools. The die member used in this invention has a projecting guide pin that fits into the tube end and extends beyond the desired location of the bead to be formed. The projecting guide pin keeps the die member aligned with the tube during the bead forming process.

In yet another example of a manual tool for forming a bead onto a tube is disclosed in U.S. Pat. No. 4,754,634, issued on Jul. 5, 1988 to Sakae Murata. In this device, the die member is guided between the legs of a U-shaped yoke and by a short pin projecting from the forming end of the die block and extending into the tube to be formed.

Other tube forming equipment are disclosed in several U.S. Patents and in particular in:

U.S. Pat. No. 4,606,214, issued on Aug. 19, 1986 to Takeshi Miyazaki;

U.S. Pat. No. 4,980,961, issued on Jan. 1, 1991 to Maurice L. Caudill;

U.S. Pat. No. 5,487,294, issued on Jan. 30, 1996 to Horst U. Petersen.

These later examples of tools of the prior art are also characterized by the fact that each has a pilot stem entering into the tube for controlling the deformation of the tube. It will be appreciated that the flared tube ends formable using a tool having a pilot stem are limited to those where the inside diameter of the tube beyond the bead is similar to the nominal inside diameter of the tube.

In view of the foregoing, it is believed that there is a significant market demand for tool kits capable of reliably swaging tube ends and providing for the replacement of outlet tubes on fuel sending units, fuel lines and power steering units, using common hand tools and equipment normally found in mechanical workshops.

SUMMARY OF THE INVENTION

In the flaring tool kits of the present invention, however, there is provided a set of simple tools including a pilotless punch for swaging tube ends with beads, with inward flares and with portions of reduced diameter. The kit is particularly useful to automechanics for reconditioning sending units on fuel tanks, using common workbench tools and equipment.

Broadly, in accordance with one feature of the present invention, there is provided, a tool kit for manually swaging a tube end, comprising a pair of semicircular clamping blocks cooperatively forming a chuck for enclosing a tube. Each clamping block has a flat portion along a segment thereof such that both blocks are forcibly retainable against one-another in a common shop vise for firmly clamping a tube. There is also provided a centering bushing having a central opening and an outside surface comprising a first and second cylindrical sections contiguous with one another and having different diameters, the first diameter being similar to the outside diameter of the chuck.

There is further provided an annular collar having an inside diameter substantially similar to the outside diameter of the chuck and to the first diameter of the centering bushing, and a width for simultaneously enclosing a portion of the chuck and the first cylindrical section of the centering bushing when the centering bushing is positioned adjacent the chuck, for centering the centering bushing with the chuck.

A round punch bar is mountable inside the central opening through the centering bushing. The punch bar has a first and second extremities, and a first pilotless swaging die in the first extremity for swaging a tube end. Further, a gauge is incorporated into the centering bushing, and this gauge has a dimension corresponding to a required length of a tube end protruding from the chuck prior to swaging the tube end.

A first advantage of the tool kit of the present invention is that the gauge incorporated in one of the pieces of the kit is readily available for positioning a tube end in the clamping blocks with an ideal length protruding from the clamping blocks to form a perfect bead or flare on the tube end. The user of the kit of the present invention does not have to search for a ruler, to verify charts, read a vernier or small graduations on a measuring instrument. The gauge being integrated into an essential component of the tool kit is kept with the kit at all times. Moreover, the gauge is a standard, or a comparative-type gauge where by the positioning of the tube is effected using more of a tactile skill than visual acuity. This aspect of the present invention prevents errors in properly positioning a tube end in the clamping blocks prior to forming the tube end, especially when the tool kit is being used in a busy workshop environment.

In another feature of the present invention, the circular clamping blocks, the centering bushing and the annular collar have a common interference and this interference is selected amongst a precision running fit and a close running fit. The centering bushing and the punch bar also have a common interference that is also a precision running fit or a close running fit. The engagement of the punch bar inside the centering bushing is at least equivalent to the length of the tube end to be formed. These interferences and engagement contribute to maintaining the punch bar along a precise alignment with the axis of the tube end. The punch bar is therefore workable with a common hammer for swaging the tube end in a precise and consistent manner.

In accordance with another feature of the present invention, there is provided a tool kit for use with a conventional manual tube flaring tool, wherein the manual flaring tool comprises a clamping bar set and a flaring yoke having a pair of spaced-apart hooked legs. In this aspect of the invention, the tool kit comprises a cylindrical pilotless forging die having a drive end, a swaging end, a circular cross section and a forming cavity in the swaging end. A saddle collar is also provided. The saddle collar has an inside diameter which is a first sliding fit dimension over the forging die and an outside diameter which is larger than a width of the clamping bar. The outside diameter of the collar is a second sliding fit dimension inside the spaced-apart legs of the yoke. The saddle collar further has a pair of tabs spaced apart a third sliding fit dimension over the width of the clamping bar.

In accordance with yet another aspect of the tool kit for use with a conventional manual tube flaring tool, the saddle collar has a gauge incorporated therein for measuring a length of tube extending from the clamping bar set. This gauge is also usable according to the aforesaid manner for preventing defects in a swaged tube end.

In yet a further aspect of the present invention there is provided a new method for manually swaging a high-pressure releasable fitting on a tube end using a round pilotless punch bar having a first die in a first end thereof. The method comprises the steps of:

A) enclosing a tube in a pair of clamping blocks;

B) positioning the tube in the clamping blocks and exposing a tube end portion of the tube beyond a surface of the clamping blocks while gauging the length of the tube end portion according to an ideal dimension of a comparative-type standard;

C) forcibly retaining the clamping blocks in a vise;

D) fittingly enclosing the clamping blocks inside an annular collar;

E) fittingly enclosing a hollow bushing inside the annular collar, and against the surface of the clamping blocks;

F) fittingly inserting the punch bar inside the hollow bushing while guiding the punch bar along an engagement dimension in the hollow bushing which is at least as long as the length of the tube end portion; and G) striking the punch bar with a hammer for working the first die cavity onto the tube end for forming a fitting on the tube end.

The method described above is particularly advantageous for swaging a high-pressure releasable fitting on a tube end using common workbench tools available in most automotive garages. The fittings formed by this method are known to have an ideal shape and for being concentric with the axis of the tube.

Other advantages of the tool kits of the present invention comprise the facts that the tool kits contain a small number of pieces, are relatively inexpensive to manufacture and are easy to use.

BRIEF DESCRIPTION OF THE DRAWINGS

Two embodiments of this invention are illustrated in the accompanying drawings, in which like numerals denote like parts throughout the several views, and in which.

DETAILED DESCRIPTION OF THE PREFERRED EMBODIMENTS

Figure 1:
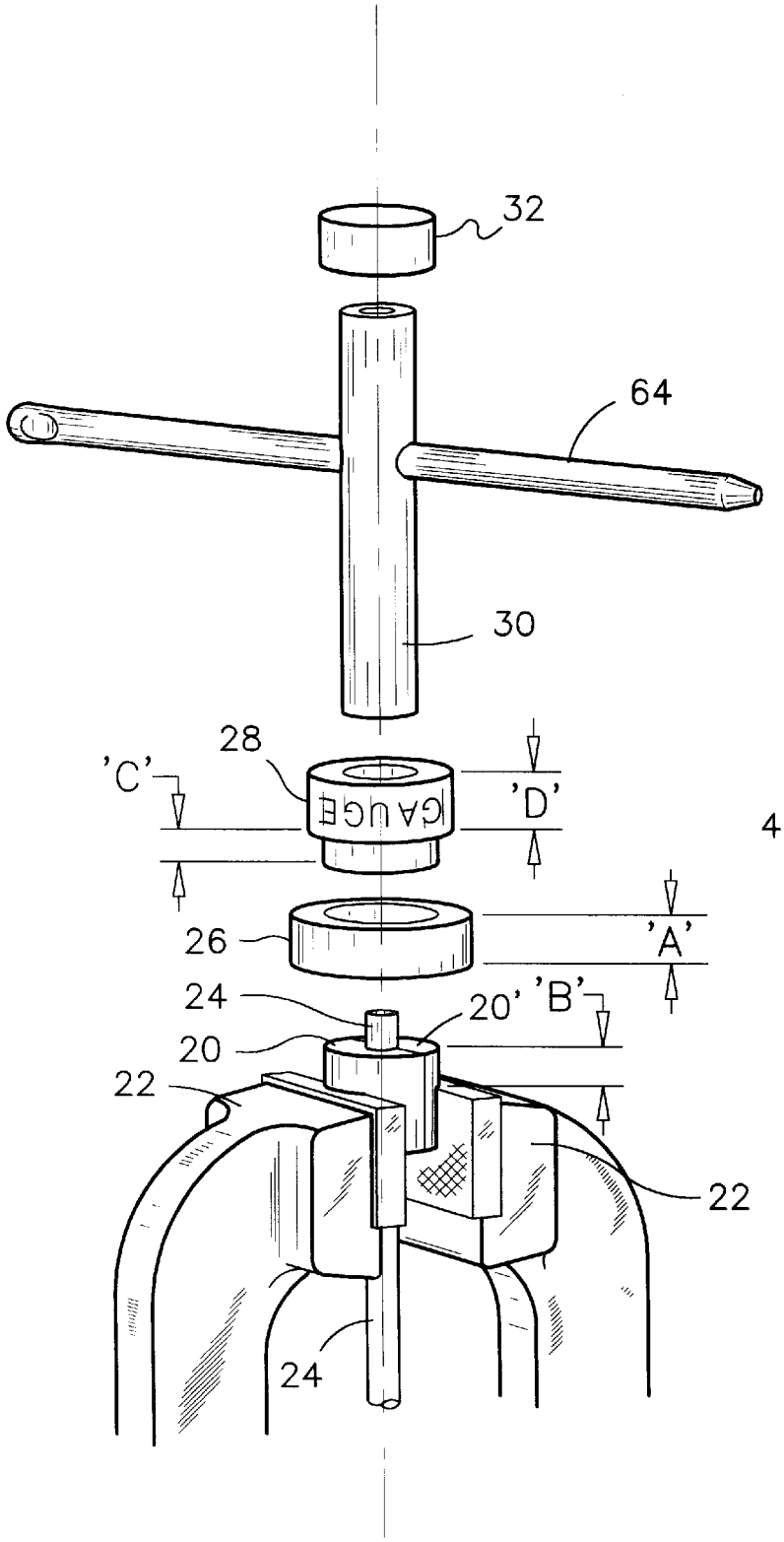
FIG. 1 is a perspective exploded view of a tool kit according to a first preferred embodiment of the present invention.

While this invention is susceptible of embodiment in many different forms, there are shown in the drawings, and will be described in details herein two specific embodiments, with the understanding that the present disclosure is to be considered as an example of the principles of the invention and is not intended to limit the invention to the embodiments illustrated.

There is illustrated in FIGS. 1–10 a first flaring tool kit according to a first preferred embodiment of the present invention. There are also illustrated two types of typical swaged tube ends formable using the tool kits of the preferred embodiments. FIGS. 7–10 in particular illustrate a preferred method of operation of the tool kit of the first preferred embodiment.

The flaring tool kit of the first preferred embodiment comprises a pair of semicircular clamping blocks 20,20' cooperatively forming a chuck enclosing the tube to be formed. Each of the clamping blocks 20-20' has a flat portion along a segment thereof such that both blocks 20,20' are forcibly retainable against one-another in a common shop vise 22 for example, for firmly clamping a tube 24 to be swaged. An annular collar 26 is provided and has an inside diameter for precisely sliding over and enclosing the portion 'B' of the clamping blocks 20-20' extending above the vise 22. A centering bushing 28 is further provided for mounting inside the annular collar 26, for guiding a first swaging punch 30, also being part of the tool kit of the first preferred embodiment.

The dimension tolerances of, or the interference between, the clamping blocks 20-20', the annular collar 26, the centering bushing 28 and the first punch 30 are selected to constitute therebetween a precision running fit (RC 3) or a close running fit (RC 4) as defined in the American National Standards Institute, ANSI B4.1-1967, R1974, entitled Standard Limits and Fits, such that the punch 30 is kept precisely centred with the axis of the tube to be formed, throughout the forming process.

The first flaring punch 30 usable with the tool kit of the first preferred embodiment consists of an elongated round bar having a tube-swaging cavity on each end thereof as will be explained later. The first punch 30 is preferably used with a protective anvil cap 32, on which a manual hammer may be stricken for forming a flared end on a tube. The anvil cap 32 preferably has a recess in its lower surface for enclosing the drive end of the punch 30 completely, thereby protecting the punch from deformations associated with repeated hammer blows thereon.

The width 'A' of the annular collar 26 is sufficient for enclosing the portion 'B' of the clamping blocks extending above the vise 22 and a first shoulder 'C' on the centering bushing 28 extending toward the clamping blocks 20-20' and having an outside diameter similar to the inside diameter of the annular collar 26. For example and for reference purposes only, the dimension 'A' is 0.675 inch (17.1 mm); the dimension 'B' is 0.290 inch (7.3 mm), and 'C' is 0.425 inch (10.8 mm). The height 'D' of the centering bushing extending above the annular collar 26 hereinafter referred to as the depth gauge 'D' is selected to correspond to the required length of tube extending above the clamping blocks 20,20' prior to swaging the tube end. The depth gauge 'D' on the centering bushing 28 is therefore usable as a gauge or a standard for properly positioning the tube 24 in the clamping blocks 20-20' and for ensuring that the proper amount of material extends above the clamping blocks 20-20' for forming a quality bead. This is one of the most important features, basically, to ensure that the tube end formed with the tool kit of the first preferred embodiment has a consistent quality.

Furthermore, the engagement of the punch bar 30 inside the centering bushing is at least a minimum dimension corresponding to the length of tube extending above the clamping blocks. It has been found that this minimum engagement dimension is required for ensuring that the punch bar remains in proper alignment with the axis of the tube. This minimum engagement of the punch bar inside the centering bushing is another most important feature to ensure that the tube end formed with the tool kit is concentric with the axis of the tube.

Figure 2:
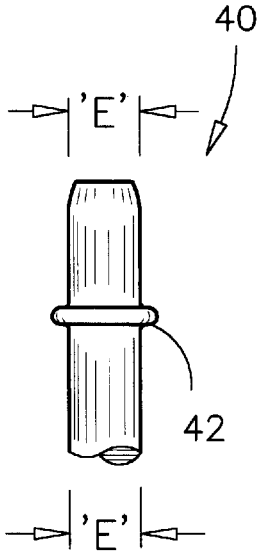
FIG. 2 is a side view of a swaged tube end of a first type.
Figure 3:
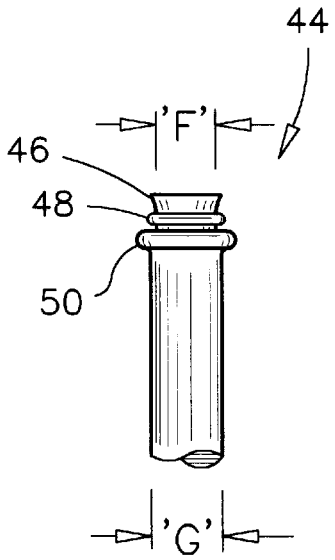
FIG. 3 is a side view of a swaged tube end of a second type.

Typical tube ends which are formable with the tool kits of the present invention are illustrated for reference purposes in FIGS. 2 and 3. These tube ends are used in the automotive industry on gas lines, sending units of gasoline tanks and power steering hydraulic piping systems. The first illustrated tube end 40 has a relatively long stem extending between a bead 42 and the end of the tube, and tapering down slightly at the open end of the tube. This type of tube end 40 is referred to in the industry as a high-pressure-clip fitting. The outside diameter of the stem 'E' is generally similar to the nominal outside diameter of the tube.

The second illustrated common tube end 44 is referred to in the industry as a high-pressure-flare fitting. It has a relatively short stem with a diameter 'F' being smaller than the nominal tube size 'G'. The open end 46 of the tube is flared outwardly and has an O-ring 48 mounted thereon next to the bead 50. A first typical diameter 'F' of the stem is 5/16 inch (7.9 mm), for a nominal tube size 'G' of 3/8 inch (9.5 mm). A second typical diameter 'F' of the stem is 1/4 inch (6.35 mm), for a nominal tube size 'G' of 5/16 inch (7.9 mm).

Figure 4:
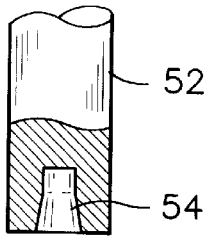
FIG. 4 is a partial cross-section view of a first end of a first punch bar usable with the tool kit according to the first preferred embodiment for swaging a tube end of the second type.
Figure 7:
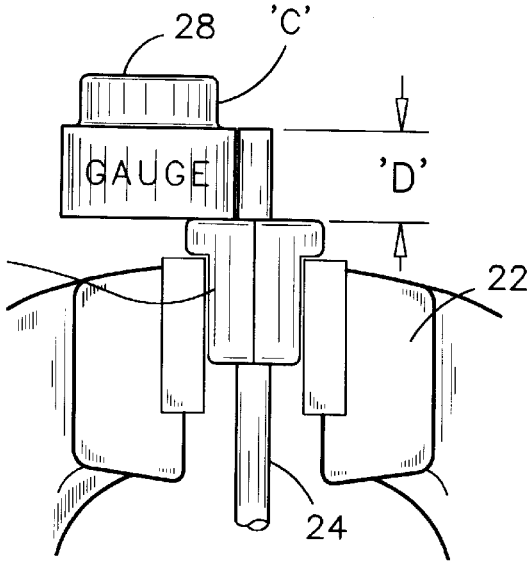
FIG. 7 is a side view of the clamping blocks and centering bushing, illustrating a method for positioning of a tube in the clamping blocks.
Figure 5:
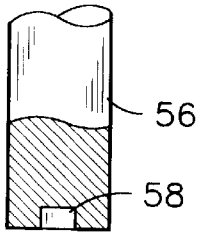
FIG. 5 is a partial cross-section view of a second end of the first punch bar illustrated in FIG. 4.
Figure 6:
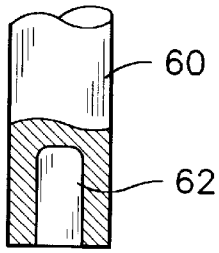
FIG. 6 is a partial cross-section view of a first end of a second punch bar usable with the tool kit according to the first preferred embodiment for swaging a tube end of the first type.
Figure 8:
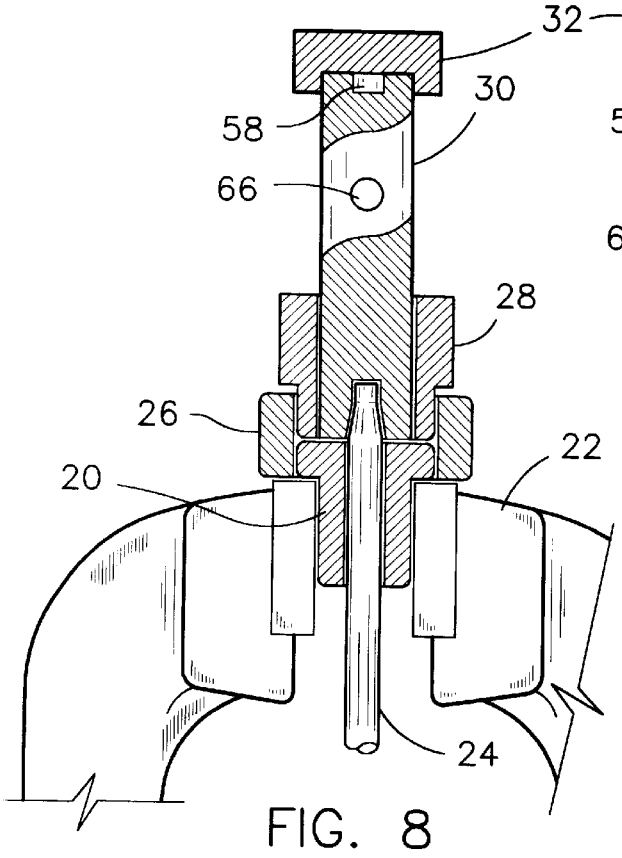
FIG. 8 is a partial cross-section of the tool kit of the first preferred embodiment, illustrating the swaging of the tube end for reducing the diameter of the tube end.
Figures 9, 10:
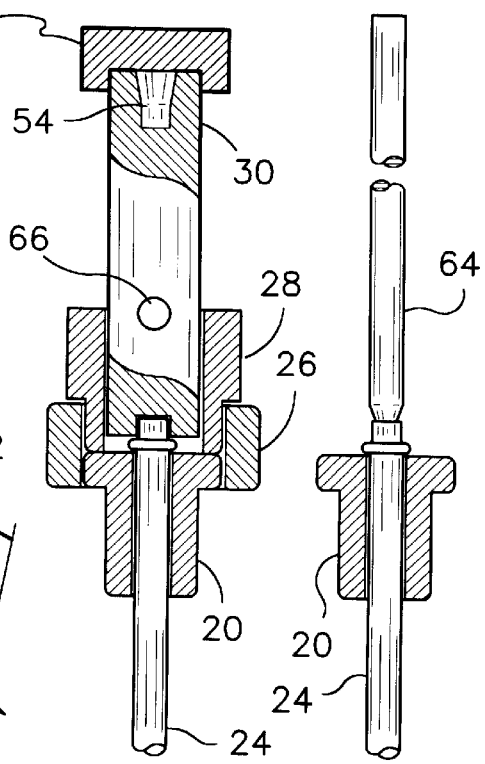
FIG. 9 is another partial cross-section of the tool kit of the first preferred embodiment, illustrating the formation of a bead on a tube end.
FIG. 10 is a cross-section view of the clamping blocks with a tube end therein, illustrating the flaring of the tube end.
Figure 11:
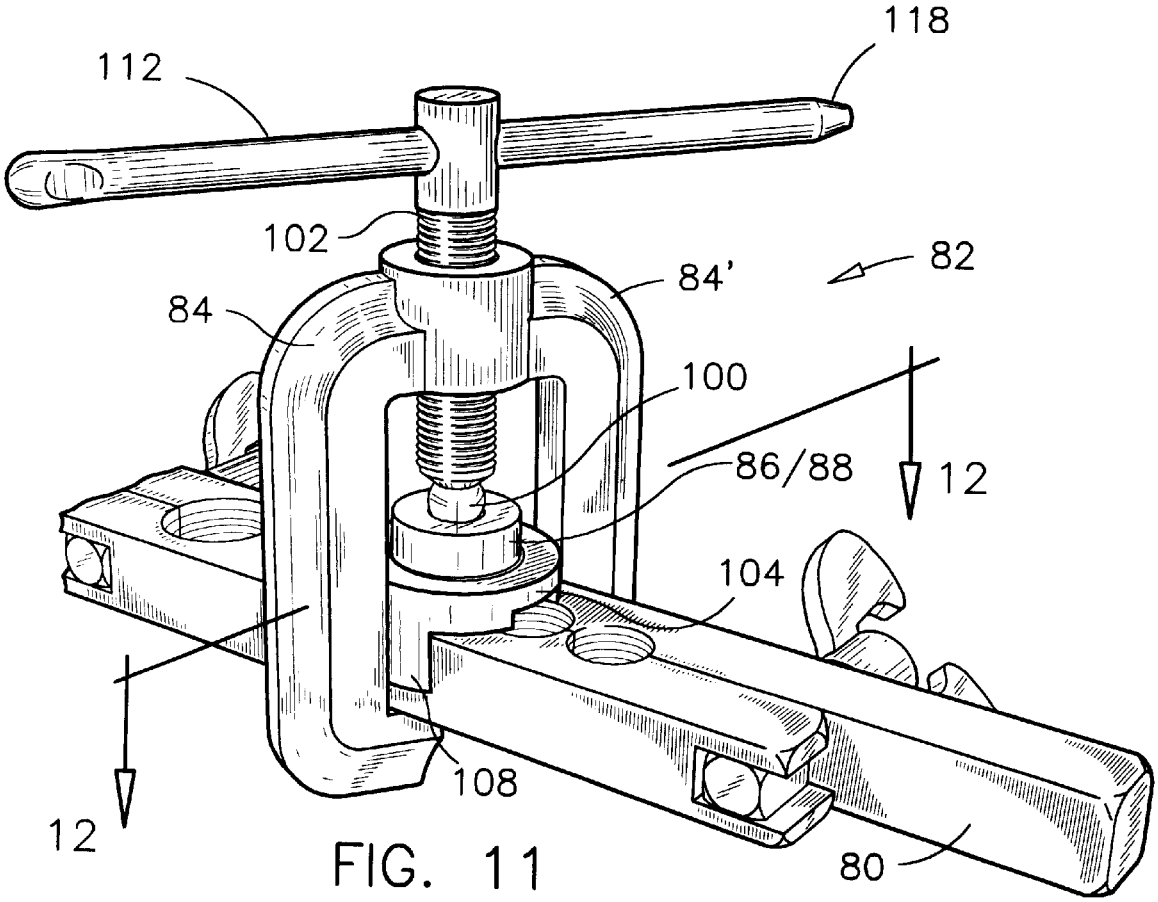
FIG. 11 is perspective view of a partial manual tool kit according to a second preferred embodiment of the present invention.
Figure 13:
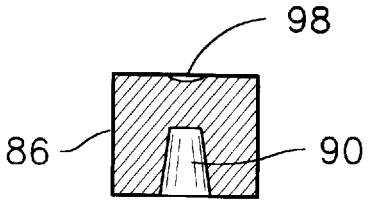
FIG. 13 is a cross section view through a first forming die usable with the tool kit of the second preferred embodiment.
Figure 12:
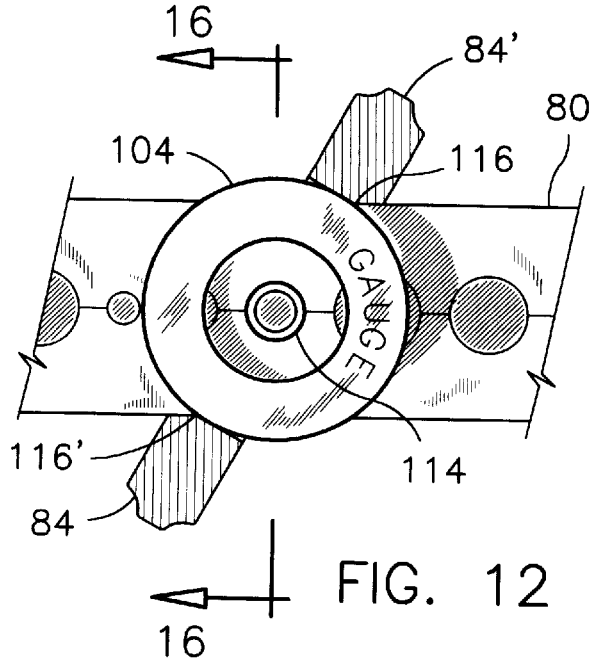
FIG. 12 is a cross-section view through the flaring yoke of the tool kit of the second preferred embodiment, illustrating the saddle collar of the tool kit as seen along line 12—12 in FIG. 11.
Figure 14:
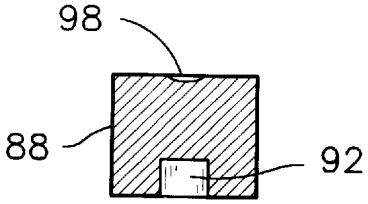
FIG. 14 is a cross section view through a second forming die usable with the tool kit of the second preferred embodiment.
Figure 15:
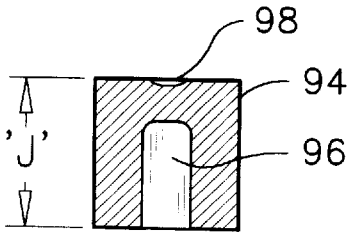
FIG. 15 is a cross section view through a third forming die usable with the tool kit of the second preferred embodiment.

The tube end of the first type 40 is formable in a single step with a second punch 60 having a straight cylindrical cavity 62 as partly illustrated in FIG. 6. The tube end of the second type 44 is formable in four steps as illustrated in FIGS. 7–10. A first step is to properly position the tube end into the clamping blocks 20-20' as illustrated in FIG. 7, while using the dimension 'D' on the centering bushing 28 to properly gauge a length of tube 24 extending above the clamping blocks 20,20'. A second step is to reduce the diameter of the tube end using a first punch end 52 having a tapering cavity 54 such as illustrated in FIG. 4. A third step comprises the forming of the bead 50 on the end of the tube using a second punch end 56 having a relatively shallow cylindrical cavity 58, with a depth equivalent to the length of the stem portion of the fitting 44. A fourth step comprises the flaring of the tube end using a pointed tool 64.

It will be appreciated that the forging cavities 54 and 58 are normally formed on respective ends of the first punch bar 30 such that a single punch bar is comprised in the tool kit of the first preferred embodiment for each size and type of tube fitting formable with a particular kit. The swaging of the tube end with the first and second punch ends is effected by striking the punch bar with a common manual ball-peen hammer.

The outward flaring of the open end 46 of the fitting of the second type is done by working a pointed rod 64 in the open end 46 of the tube 24 with a hammer or by hand by swaying the rod sideways and around the axis of the tube. The pointed rod 64 is also used as a handle that is preferably insertable in a hole 66 extending diametrically through the first punch bar 30 as illustrated in FIG. 1, for working the first punch bar 30 loose from a formed tube end.

While the depth gauge 'D' on the centering bushing 28 has been described for use with the first punch bar 30, it will be appreciated that a second centering bushing (not shown) with a second depth gauge incorporated therein is preferred for use with the second punch 60 for forming a tube end of the first type 40. It will also be appreciated that a separate centering bushing having a distinct dimension 'D' and distinct identification marks is preferably supplied for each size and type of tube end formable with a particular kit.

The aforesaid method has been found particularly efficient for manufacturing flared tube ends of consistent precision and quality on copper, aluminium and steel tubing. It has also been found that the tool kit of the first preferred embodiment is usable for forming a flared tube end in less than a couple of minutes (in less than one minute for the experienced person) with few hammer blows using a common ball-peen hammer. The tool kit of the preferred embodiment is particularly useful to mechanics repairing late model vehicles having the flared tube ends described herein.

Referring now to FIGS. 11–17, the tube flaring tool kit according to a second preferred embodiment of the invention is illustrated therein. The flaring tool kit according to the second preferred embodiment is usable with a conventional tube-clamping-bar set 80 and a manual flaring yoke 82. The flaring yoke 82 of the conventional type has a pair of hooked legs 84,84' spaced apart a distance which is slightly larger than the width of the clamping bar set 80 as is customary with these tools. The tool kit of the second preferred embodiment comprises a first and second forming dies 86,88 having respectively a tapering cavity 90 and a bead-forming cavity 92 for forming a flared tube end of the second type 44 as illustrated in FIG. 3. Similarly, a single forming die 94 having a deep tapering cavity 96 is required for forming the flared tube end of the first type 40 as illustrated in FIG. 2. Each of forming dies 86,88,94 has a cylindrical shape and a dimple 98 on its upper end for receiving the rounded tip 100 of a screw press 102 on the manual flaring yoke 82.

The tool kit of the second preferred embodiment also comprises a saddle collar 104 having an inside diameter of appropriate dimensions for precisely sliding over each of the cylindrical forming dies 86,88,94. The saddle collar 104 has an outside diameter which is slightly larger than the width of the clamping bar set 80, and which is preferably sized for providing a precise sliding fit between the hooked legs 84,84' of the yoke. The sliding fits mentioned herein are similar to those specified earlier when describing the tool kit of the first preferred embodiment.

The saddle collar 104 also has a first diametrical slot 106 across the lower surface thereof. The slot 106 has a width substantially the same as the width of the clamping bar set 80 such that it is precisely mountable astride over the clamping bar set 80. The first diametrical slot 106 defines a pair of tabs 108,108' extending downward on both sides of the clamping bar set 80 when the saddle collar is positioned on the clamping bar set and is centred with a tube to be flared.

A thickness 'H' of the saddle collar 104 is preferably equivalent to the length of tube required for forming the flared end, such that the collar is usable as a standard for properly positioning the tube in the clamping bar set 80.

The purpose of the first diametrical slot 106 and of both tabs 108,108' is for keeping the saddle collar 104 centred about the tube to be formed, and for preventing both legs 84,84' of the yoke 82 from moving along the clamping bar set 80, or from tilting sideways during the forming of the flared tube end.

Figure 17:
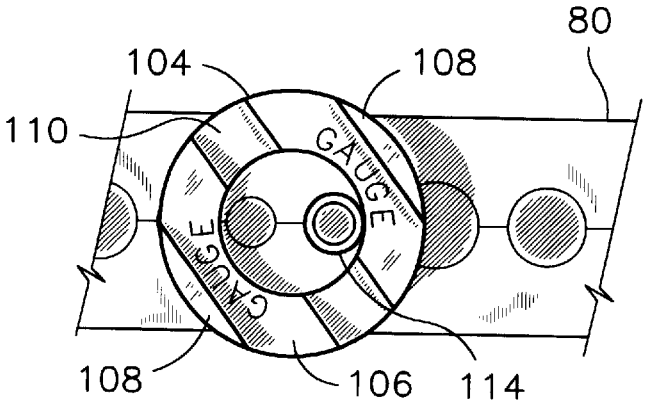
FIG. 17 is a plan view of the clamping bar set and saddle collar usable with the tool kit of the second preferred embodiment in a position for gauging a proper length of a tube end to be formed.
Figure 16:
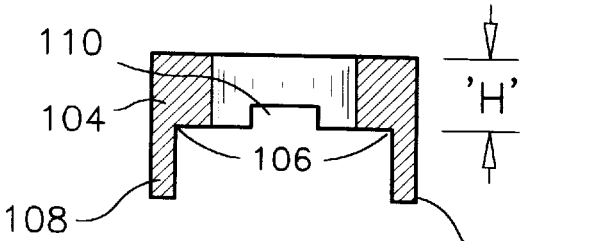
FIG. 16 is a cross section view through the saddle collar usable with the tool kit of the second preferred embodiment as seen along line 16—16 in FIG. 12.

In use, a tube is secured in the clamping bar set 80; the saddle collar 104 is placed over the bar set and moved against the tube for gauging a length of tube extending from the bar set. In case of a tube end of the first type 40, the height 'J' of the third die member 94 is used as a gauge for measuring the tube end protruding above the clamping bar set 80. For a tube end of the second type 44 as illustrated in FIG. 3, the saddle collar 104 is placed against the tube 114 for precisely measuring the portion of the tube extending above the bar set 80, and for properly clamping the tube 114, as illustrated in FIG. 17. The tapering die 86 is then placed over the end of the tube, and into the saddle collar 104. The flaring yoke 82 is positioned on the clamping bar set 80 with one leg on each side of the saddle collar 104 and in simultaneous contact with the clamping bar set 80 and the saddle collar 104. Then, the screw press 102 of the manual flaring yoke 82 is actuated for pushing the tapering die 86 against the tube end for swaging the tube end. The tapering die 86 is then replaced by the bead-forming die 88 and the screw press 102 is worked again for forming the bead 50 on the tube end 44.

The saddle collar 104 further has a second diametrical slot 110 inside and parallel to the first diametrical slot 106. When the saddle collar 104 is installed over the clamping bar set 80, the second slot 110 constitutes a window for monitoring a proper formation of the bead 50 on the tube end.

In the manual flaring tool illustrated herein, the flaring yoke 82 is centred transversally relative to the bar set 80 by twisting the tool and placing both legs 84,84' against a respective side of the bar set 80. The flaring tool 82 is centred longitudinally relative to the bar set 80 by having both legs 84,84' in contact with the saddle collar 104.

The use of a saddle collar 104 in combination with a cylindrical forging die 86 ensures that the flaring yoke 82 is properly and rigidly aligned with the tube 114 to be formed, along a longitudinal and transversal axis of the clamping bar set 80. In this arrangement, both legs 84,84' of the yoke 82 are held into a pair of notches 116,116' defined by the saddle collar 104 and the sides of the clamping bar set 80. Because these notches 116,116' have the thickness of the bar set 80 plus the thickness 'H' of the saddle collar 104, the flaring yoke 82 is held in a stable and positive manner against movement along the clamping bar set 80, as well as against tilting relative to the axis of the tube to be formed 114. Further, when pressure is applied on the screw press 102, the friction of the hooked legs 84,84' against the underside of the clamping bar set 80 prevents the saddle collar 104 from moving along the bar set 80. Thus, the interlocking arrangement of the saddle collar 104 with the flaring yoke 82 and with the clamping bar set 80 maintains the screw press 102 centred with the axis of the tube 114. This is one of the main reasons, basically, that the swaged tube ends forged with the tool kit of the second preferred embodiment have a consistent precision and quality.

A last step in forming the flared tube end of the second type as illustrated in FIG. 3, is to enlarge the end of the tube at 46. The handle 112 of the manual screw press 102 advantageously has a pointed end 118 for working the tube end 46 as previously explained.

While two embodiments of the present invention have been illustrated in the accompanying drawings and described hereinabove, it will be appreciated by those skilled in the art that various modifications, alternate constructions and equivalents may be employed without departing from the true spirit and scope of the invention. Therefore, the above description and the illustrations should not be construed as limiting the scope of the invention which is defined by the appended claims.

I claim:

1. A tool kit for swaging tube ends, comprising:

a clamping bar set having a width, a length and means for clamping a tube end to be swaged;

a swaging die having a spaced-apart parallel drive end and swaging ends, a cylindrical shape between said drive end and said swaging end and a tube-forming cavity in a center of said swaging end;

a saddle collar having an annular shape, an inside diameter and an outside diameter, said inside diameter being a first fit dimension over said cylindrical shape of said swaging die for providing for a fitted engagement thereof over said swaging die, and said outside diameter being larger than said width of said clamping bar set; said saddle collar further having a pair of tabs spaced apart a second fit dimension over said width of said clamping bar set for providing for a fitted engagement thereof over said clamping bar set with said tabs extending astride said clamping bar set;

a flaring yoke having a pair of legs spaced apart a third fit dimension over said outside diameter of said saddle collar for providing for a precise installation thereof over said saddle collar with said legs extending astride said outside diameter of said saddle collar; said flaring yoke also having hook means on said legs for engagement with said clamping bar set, and a screw press centered between said legs and having means for engagement with said swaging die for pressing said swaging die on a tube end to be formed;

such that said swaging die is concentrically mountable on a tube end when said tube end is adapted to be clamped in said clamping bar set; said saddle collar is concentrically mountable over said swaging die and said flaring yoke is precisely installable on said clamping bar set with said legs extending astride said clamping bar set and said saddle collar, and is positional with said legs being in simultaneous contact with said clamping bar set and with said saddle collar in a pair of notches defined by an integration of said clamping bar set and said saddle collar and is restrainable longitudinally and transversally in said notches relative to said clamping bar set and said saddle collar, for maintaining said screw press centered with an axis of said tube end.

2. The tool kit as claimed in claim 1, wherein said screw press has a rounded tip, and said swaging die has a dimple in said drive end for engagement with said rounded tip.

3. The tool kit as claimed in claim 2, further comprising a handle bar for actuating said screw press, and said handle bar has a pointed end which is usable for flaring a tube end.

4. The tool kit as claimed in claim 1, wherein said saddle collar has window means for visually monitoring a formation of a bead on a tube end.

5. The tool kit as claimed in claim 1, wherein said tabs define a first diametrical slot across a surface of said saddle collar, and said window means is a second diametrical slot inside said first diametrical slot.

6. The tool kit as claimed in claim 1, wherein said saddle collar has a gauge incorporated therein for measuring a length of a tube end extending from said clamping bar set, when said tube end is adapted to be positioned in said clamping bar set.

7. The tool kit as claimed in claim 1, wherein said flaring yoke and said saddle collar have a first common interference, and said saddle collar and said clamping bar set have a second common interference, and said first and said second common interferences are selected amongst a precision running fit and a close running fit.

8. A tool kit for swaging tube ends, comprising:

a clamping bar set having a width, a length and means for clamping a tube end to be swaged;

a tube end clamped in said clamping bar set;

a swaging die having spaced-apart parallel drive end and swaging end, a cylindrical shape between said drive end and said swaging end and a tube-forming cavity in a center of said swaging end, said swaging die being set over said tube end;

a saddle collar having an annular shape, an inside diameter and an outside diameter, said inside diameter being a first fit dimension over said cylindrical shape of said swaging die and being fitly engaged over said swaging die, and said outside diameter being larger than said width of said clamping bar set; said saddle collar further having a pair of tabs spaced apart a second fit dimension over said width of said clamping bar set and being fitly mounted over said clamping bar set with said tabs extending astride said clamping bar set;

a pair of notches defined by said tabs and said clamping bar set and extending in a parallel alignment with an axis of said tube end;

a flaring yoke having a pair of legs spaced apart a third fit dimension over said outside diameter of said saddle collar and being fitly mounted over said clamping bar set and said saddle collar with said legs extending astride said outside diameter of said saddle collar in said pair of notches and in simultaneous contact with said clamping bar set and said saddle collar; said flaring yoke also having hook means on said legs engaged with said clamping bar set, and a screw press centered between said legs and engaged with said swaging die for pressing said swaging die on said tube end;

such that said swaging die is concentrically restrained over said tube end; said saddle collar is concentrically restrained over said swaging die and said flaring yoke is longitudinally and transversally restrained relative to said clamping bar set and said saddle collar, for swaging said tube end with precision.

9. The tool kit as claimed in claim 8, further comprising a handle bar for actuating said screw press, and said handle bar has a pointed end which is usable for flaring a tube end.

10. The tool kit as claimed in claim 8, wherein said saddle collar has window means for visually monitoring a formation of a bead on said tube end.

* * * * *